US010515773B2

(12) United States Patent
Hua

(10) Patent No.: US 10,515,773 B2
(45) Date of Patent: Dec. 24, 2019

(54) TIME SWITCH OF CONTROLLABLE TIME ADJUSTMENT

(71) Applicant: Yaowu Hua, Shenzhen (CN)

(72) Inventor: Yaowu Hua, Shenzhen (CN)

( * ) Notice: Subject to any disclaimer, the term of this patent is extended or adjusted under 35 U.S.C. 154(b) by 385 days.

(21) Appl. No.: 15/277,467

(22) Filed: Sep. 27, 2016

(65) Prior Publication Data

US 2017/0040130 A1 Feb. 9, 2017

Related U.S. Application Data

(63) Continuation of application No. PCT/CN2014/074594, filed on Apr. 2, 2014.

(30) Foreign Application Priority Data

Mar. 28, 2014 (CN) ..... 2014 2 0148263 U

(51) Int. Cl.
*H01H 50/54* (2006.01)
*H01H 43/02* (2006.01)
*H01H 19/54* (2006.01)

(52) U.S. Cl.
CPC ..... *H01H 43/022* (2013.01); *H01H 19/54* (2013.01); *H01H 43/024* (2013.01); *H01H 2235/01* (2013.01); *H01H 2239/034* (2013.01)

(58) Field of Classification Search
CPC ..... H01H 43/022; H01H 43/024; H01H 19/54
USPC ..... 335/2
See application file for complete search history.

(56) References Cited

U.S. PATENT DOCUMENTS 4,870,230 A * 9/1989 Osika ..... H01H 3/20 200/6 R
4,947,009 A * 8/1990 Osika ..... H01H 3/20 200/43.16
5,047,598 A * 9/1991 Osika ..... H01H 3/20 200/322
2005/0109598 A1* 5/2005 Endres ..... H01H 19/635 200/339

(Continued)

*Primary Examiner* — Shawki S Ismail
*Assistant Examiner* — Lisa N Homza
(74) *Attorney, Agent, or Firm* — Wayne & Ken, LLC; Tony Hom

(57) ABSTRACT

A time switch of controllable time adjustment, the time switch comprising a switch housing (10), a control circuit board (9) arranged inside the switch housing (10), an input terminal (6) and an output terminal (7) arranged on the bottom surface of the switch housing (10), a connecting piece (5) for connecting the input terminal (6) and the output terminal (7), a warped plate (2) connecting to the switch housing (10) by means of a rotating shaft, a first spring (4) provided between the warped plate (2) and the connecting piece (5). The warped plate (2) swaying about the rotating shaft drives the connecting piece (5) to sway. The swaying of the connecting piece (5) causes the input, terminal (6) and the output terminal (7) to complete closing and opening. The control circuit board (9) is electrically connected to the output terminal (7). The time switch has a simple structure and a convenient installation, so it can be installed in various electric appliances needing to realize a timing function. The time switch has a simple structure and a convenient installation, so it can be installed in various electric appliances needing to realize a timing function.

6 Claims, 3 Drawing Sheets

(56) References Cited

U.S. PATENT DOCUMENTS

| | | | | |
|---|---|---|---|---|
| 2005/0115818 | A1* | 6/2005 | Kurek | H01H 23/025<br>200/553 |
| 2006/0108211 | A1* | 5/2006 | Endres | H01H 19/635<br>200/558 |
| 2006/0131152 | A1* | 6/2006 | Endres | H01H 19/635<br>200/339 |
| 2007/0095642 | A1* | 5/2007 | Endres | H01H 19/635<br>200/339 |
| 2009/0160354 | A1* | 6/2009 | Burrell | H01H 23/30<br>315/291 |

* cited by examiner

TIME SWITCH OF CONTROLLABLE TIME ADJUSTMENT

CROSS-REFERENCE TO RELATED APPLICATIONS

This application is a continuation of International Patent Application No. PCT/CN2014/074594 with a filing date of Apr. 2, 2014, designating the United States, now pending, and further claims priority to Chinese Patent Application No, 201420148263.2 with a filing date of Mar. 28, 2014. The content of the aforementioned applications, including any intervening amendments thereto, are incorporated herein by reference.

TECHNICAL FIELD

The present invention relates to the field of switch, and more specifically, to a time switch capable of setting time freely to control the switch disconnection.

BACKGROUND OF THE INVENTION

To solve stand-by power consumption on the electrical appliances, many product designers design a time switch circuit on the electrical appliances. When the time switch is connected in the circuit, the electrical appliances can judge power on or off according to the setting time, so that the stand-by state can be stopped in time and power consumption can be saved.

In industry practice, time switch is generally supplied to manufacturers of electrical appliances as finished switch, and the manufacturers design corresponding circuit module and installation structure on electrical goods to match with the appearance of time switch. Currently, there are two types of time switch at home and abroad, one is permanent magnet type in a way of suction, its product structure determines defects of unstable performance, poor hand feeling in opening and closing button during using; the other is spring-type rocker switch, which has good hand feeling due to optimization of inner springback structure, and this time switch is frequently used in China. Traditional time switch described hereinafter is spring-type rocker switch.

The structure of traditional time switch comprises a cuboid-shaped switch body, a circuit board and touch points are arranged inside the switch body, a ship-shaped button is arranged in front of the switch body, rotating shaft holes are arranged on both sides of the ship-shaped button, the touch points are aligned to two ends of the ship-shaped knob. It is necessary that the rotating shaft is inserted into the rotating shaft holes because pulling action of both ends of the ship-shaped button needs to be realized. However, for traditional time switch, structure designs such as rotating shaft, are solved by manufacturers of electrical appliances, that is, a switch mounting bracket for embedding switch body is designed on panel of electrical appliances, and a rotating shaft is arranged on the mounting bracket. In this way, the manufacturing and assembling of the complete set of time switch meet trouble, many structures of electrical appliances' panel are interfered with each other and are not easy to open the mold; accessories are scattered, the assembly of time switch is unstable; because products are designed independently by both sides, it cannot be well matched in actual assembling; ship-shaped button is single and replacement is difficult.

SUMMARY OF THE INVENTION

The present invention aims to solve problems of single button and difficult replacement by providing a time switch of controllable time adjustment.

The present invention is realized as follows: a time switch of controllable time adjustment, the time switch comprises a switch housing, a control circuit board arranged inside the switch housing, an input terminal and an output terminal arranged on the bottom surface of the switch housing, a connecting piece for connecting the input terminal and the output terminal, a warped plate connecting to the switch housing by means of a rotating shaft; a first spring is provided between the warped plate and the connecting piece to enable the warped plate swaying around the rotating shaft and driving the connecting piece to sway; the swaying of the connecting piece causes the input terminal and the output terminal to complete closing and opening; and the control circuit board is electrically connected with the output terminal.

A further technical scheme of the present invention is the time switch also comprises a timing rotary switch, the timing rotary switch is electrically connected with the control circuit board; and the timing rotary switch connects with the control circuit board in a plugging way by a plug wire.

A further technical scheme of the present invention is the timing rotary switch comprises a first circuit board, a rotary switch, a rotary knob and a case; a circular hole is arranged on the top surface of the case, the rotary knob is exposed out of the case through the circular hole for rotation, the rotary switch is arranged on the first circuit board; the rotary knob is sleeved on a rotary shaft of the rotary switch; and the first circuit board is connected with the control circuit board by the plug wire.

A further technical scheme of the present invention is the time switch also comprises a waterproof rubber ring, the waterproof rubber ring is arranged inside the switch housing; and the waterproof rubber ring is provided between the warped plate, the connecting piece and the control circuit board.

A further technical scheme of the present invention is the time switch also comprises a bottom cover, the bottom cover is connected to the body of the time switch via a first buckle.

A further technical scheme of the present invention is an opening is provided on the top surface of the warped plate; a lamp cover is connected with the inner of the opening via a second buckle.

A further technical scheme of the present invention is an electromagnet is arranged on the control circuit board; and a control circuit is arranged inside the control circuit board.

A further technical scheme of the present invention is the electromagnet comprises a copper coil, a coil framework, a second spring, a terminal and an iron core, the second spring is sleeved on the iron core, the iron core is arranged inside the coil framework, the copper coil is wound and sleeved on the coil framework; the terminal is provided on the coil framework; and the copper coil is electrically connected to the terminal.

A further technical scheme of the present invention is the control circuit comprises a coil J1, a resistor R4, a resistor R3, a resistor R2, a resistor R1, a capacitor C1, a capacitor C4, a diode D1, a diode D2, a neon tube N-LD, a silicon controlled rectifier Q1, a control chip U1 and a connector JP1, an input voltage is connected to the input terminal of the coil, the output terminal of the coil is respectively connected to one end of the resistor R4 and the second pin of the silicon controlled rectifier Q1, the other end of the resistor R4 is grounded, the first pin of the silicon controlled rectifier Q1 is grounded, the third pin of the silicon controlled rectifier Q1 is connected to one end of the resistor R3, the other end of the resistor R3 is connected to the fifth pin of the control chip U1, one end of the capacitor C4 is grounded, and the other end is respectively connected to the third pin of a triode Q5 and the third pin of a triode Q1, the eighth pin of the control chip U1 is respectively connected to the third pin and the sixth pin of the connector JP1, the seventh pin of the control chip U1 is connected to the third pin of the connector JP1, the sixth pin of the control chip U1 is grounded, the third pin and the fourth pin of the control chip iJ t are respectively connected to the first pin of the connector JP1, the second pin of the control chip U1 is connected to the second pin of the connector JP1, the first pin of the connector JP' is respectively connected to the cathode of the diode D2 and the anode of the capacitor C1, the anode of the diode D2 and the cathode of the capacitor C1 are grounded, the anode of the diode D1 is connected to one end of the resistor R1, and the other end of the resistor R1 is connected to the input voltage, one end of the resistor R2 is grounded, and the other end of the resistor R2 is connected to the anode of the neon tube N-LD, the cathode of the neon tube N-LD is connected to the input voltage.

A further technical scheme of the present invention is a time adjusting circuit is arranged on the first circuit board, the time adjusting circuit comprises a control chip U2, a capacitor C5, a diode D3, a rotary switch SW1 and a connector JP2, the first pin of the control chip U2 is connected to the third pin of the connector JP2, the second pin of the the control chip U2 is grounded, the third pin of the control chip U2 is connected to the third pin of the rotary switch SW1, the fourth pin of the control chip U2 is connected to the first pin of the rotary switch SW1, the fifth pin of the control chip U2 is connected to the input voltage, the sixth pin of the control chip U2 is connected to the sixth pin of the rotary switch SW1, the seventh pin of the control chip U2 is connected to the fourth pin of the rotary switch SW1, the eighth pin of the control chip U2 is unconnected, the ninth pin of the control chip U2 is connected to the first pin of the connector JP2, the tenth pin of the control chip U2 is connected to the second pin of the connector JP2, one end of the diode D3 is connected to the first pin of the connector JP2, and the other end of the diode D3 is respectively connected to the anode and input voltage of the capacitor C5, the cathode of the capacitor C5 is grounded, the second pin and the fifth pin of the rotary switch SW1 are grounded.

The beneficial effects of the present invention is as follows: the present invention has a rotating shaft in the time switch, so that manufacturers of electric appliances using the switch have no need to design the rotating shaft on the switch mounting bracket of electrical appliances, and reduce trouble of mold design; in addition, a middle clamping rack is disposed, through which the switch body can be easily installed on the panel, and it is very easy to be assembled and disassembled due to clamping structure. The present invention has a simple and reliable structure and a convenient installation, so it can be installed in various electric appliances needing to realize a timing function.

DETAILED DESCRIPTION OF THE INVENTION

Reference numbers: 1—lamp cover; 2—warped plate; 3—waterproof rubber ring; 4—first spring; 5—connecting piece; 6—input terminal; 7—output terminal; 8—terminal; 9—control circuit board; 10—switch housing; 11—copper coil; 12—coil framework; 13—second spring; 14—iron core; 15—bottom cover; 16—rotating shaft; 17—first buckle; 18—second buckle.

Figure 1:
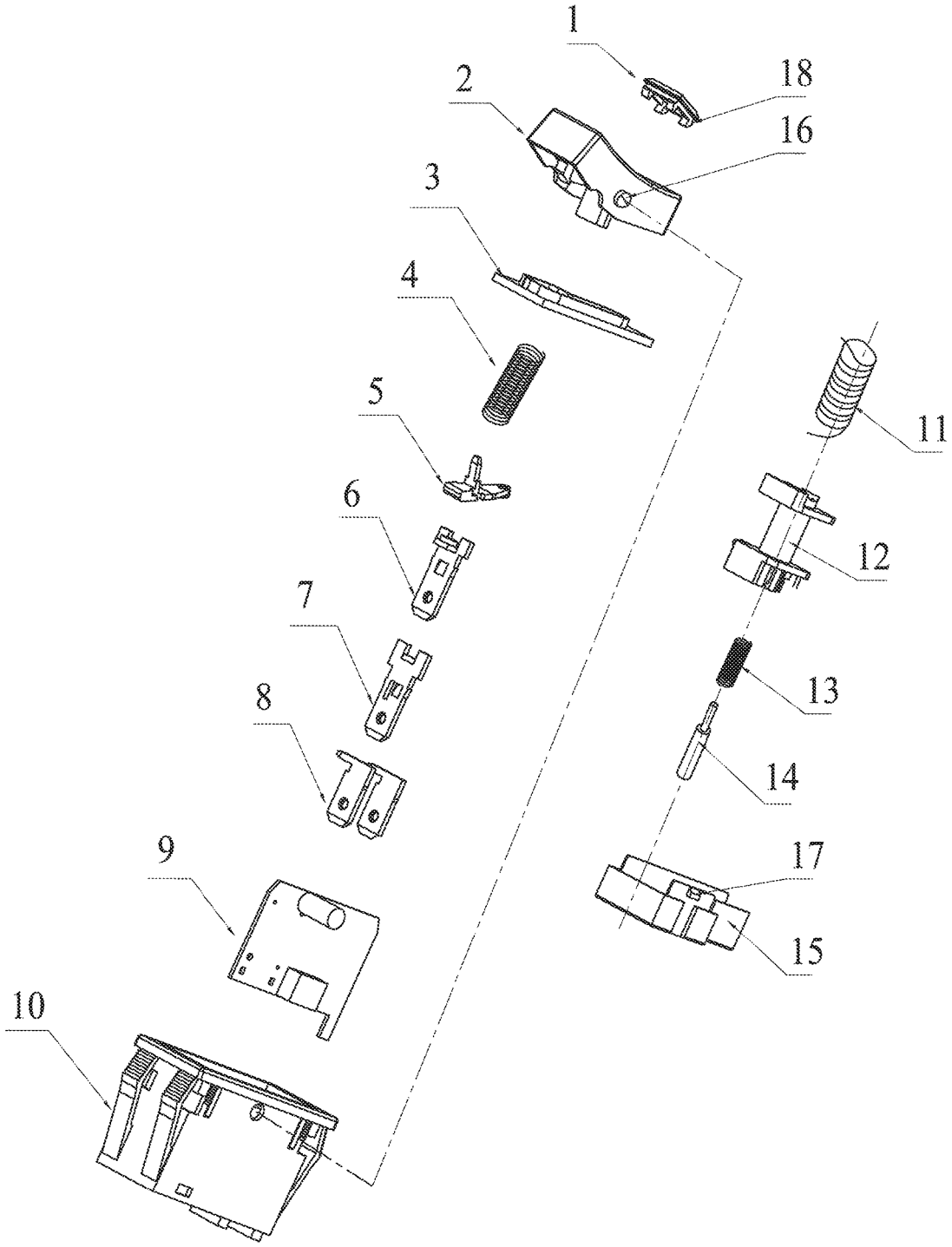
FIG. 1 is a break-down structure diagram of a time switch of controllable time adjustment of the present invention.
Figure 2:
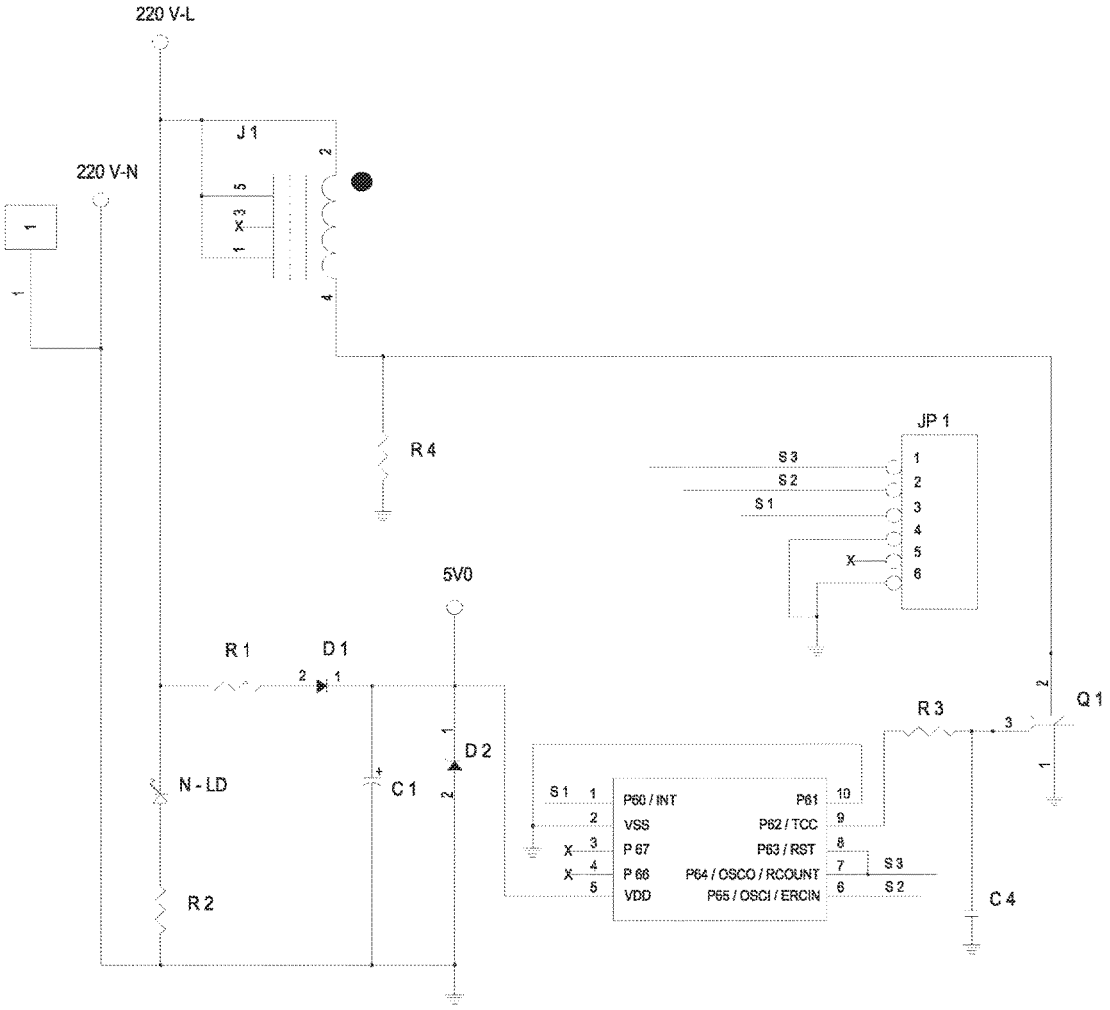
FIG. 2 is a circuit diagram of a control circuit of a time switch of controllable time adjustment of the present invention.
Figure 3:
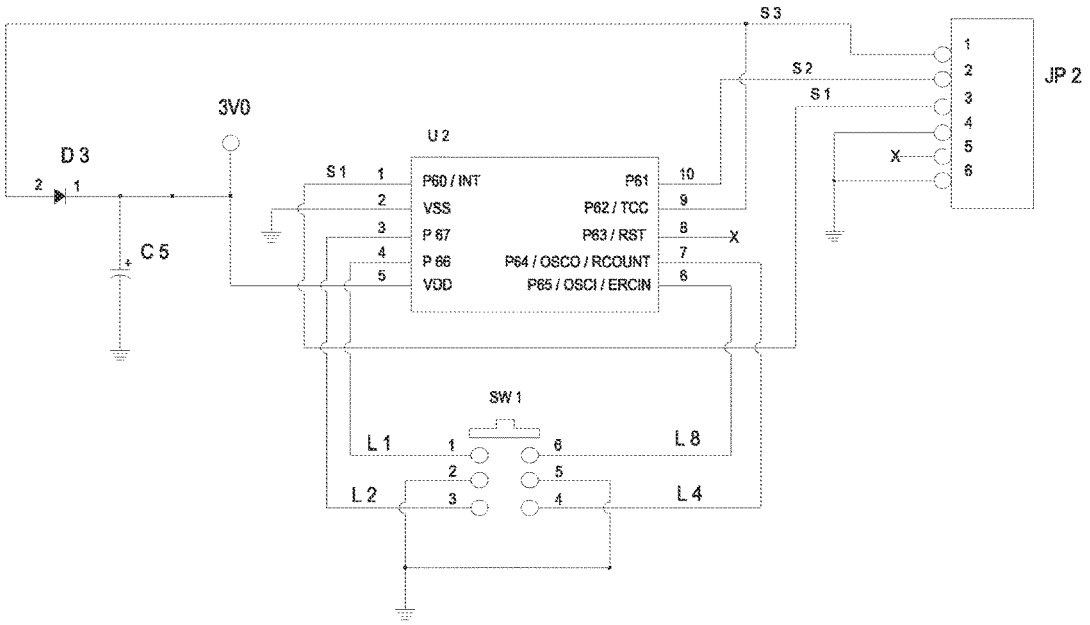
FIG. 3 is a circuit diagram of a timing circuit of a time switch of controllable time adjustment of the present invention.

FIG. 1 shows a time switch of controllable time adjustment of the present invention, the time switch comprises a switch housing 10, a control circuit board 9 arranged inside the switch housing 10, an input terminal 6 and an output terminal 7 arranged on the bottom surface of the switch housing 10, a connecting piece 5 for connecting the input terminal 6 and the output terminal 7, a warped plate 2 connecting to the switch housing 10 by means of a rotating shaft 16. A first spring 4 is provided between the warped plate 2 and the connecting piece 5 enabling the warped plate 2 to sway around the rotating shaft 16 and drive the connecting piece 5 to sway. The swaying of the connecting piece 5 causes the input terminal 6 and the output terminal 7 to complete closing and opening, and the control circuit board 9 is electrically connected with the output terminal 6. The present invention has a rotating shaft 16 in the time switch, so that manufacturers of electric appliances using the switch have no need to design the rotating shaft 16 on the switch mounting bracket of electrical appliances, and reduce trouble of mold design; in addition, a middle clamping rack is disposed, through which the switch body can easily installed on the panel, and it is very easy to be assembled and disassembled due to clamping structure. The present invention has a simple and reliable structure and a convenient installation, so it can be installed in various electric appliances needing to realize a timing function.

After the bottom cover and the circuit board are combined and connected with the switch housing, the whole product design has delicate structure, so that the product has smaller volume, lower cost, and easy installation, besides, it is convenient for users to install and use.

The time switch also comprises a timing rotary switch, the timing rotary switch is electrically connected to the control circuit board 9, the timing rotary switch is electrically connected with the control circuit board; and the timing rotary switch connects with the control circuit board in a plugging way by a plug wire. The time of switch disconnection can be set freely, so that actual demand meet users' need.

The timing rotary switch comprises a first circuit board, a rotary switch, a rotary knob and a case, a circular hole is arranged on the top surface of the case, the rotary knob is exposed out of the case through the circular hole for rotation, the rotary switch is arranged on the first circuit board, the rotary knob is sleeved on a rotary shaft of the rotary switch; and the first circuit board is connected with the control circuit board 9 by the plug wire.

The time switch also comprises a waterproof rubber ring 3, the waterproof rubber ring 3 is arranged inside the switch housing 10, the waterproof rubber ring 3 is provided between the warped plate 2, the connecting piece 5 and the control circuit board, so that small amount of water inside can be discharged to prevent short circuit inside the switch.

The time switch also comprises a bottom cover 15, the bottom cover 15 is connected to the switch housing 10 via a first buckle 17. Buckle connection is convenient for disassembling and maintenance.

An opening is provided on the top surface of the warped plate 2, a lamp cover is connected with the inner of the opening via a second buckle 18, so that indication of neon tube shining can be obtained.

An electromagnet is arranged on the control circuit board 9, and a control circuit is arranged inside the control circuit board 9.

The electromagnet comprises a copper coil 11, a coil framework 12, a second spring 13, a terminal 8 and an iron core 14, the second spring 13 is sleeved on the iron core 14, the iron core 14 is arranged inside the coil framework 12, the copper coil 11 is wound on the coil framework 12, the terminal 8 is provided on the coil framework 12 and the copper coil 11 is electrically connected to the terminal 8.

The control circuit comprises a coil 11, a resistor R4, a resistor R3, a resistor R2, a resistor R1, a capacitor C1, a capacitor C4, a diode D1, a diode D2, a neon tube N-LD, a silicon controlled rectifier Q1, a control chip U1 and a connector JP1, an input voltage is connected to the input terminal of the coil, the output terminal of the coil is respectively connected to one end of the resistor R4 and the second pin of the silicon controlled rectifier Q1, the other end of the resistor R4 is grounded, the first pin of the silicon controlled rectifier Q1 is grounded, the third pin of the silicon controlled rectifier Q1 is connected to one end of the resistor R3, the other end of the resistor R3 is connected to the fifth pin of the control chip U1, one end of the capacitor C4 is grounded, and the other end is respectively connected to the third pin of a triode Q5 and the third pin of a triode Q1, the eighth pin of the control chip U1 is respectively connected to the third pin and the sixth pin of the connector JP1, the seventh pin of the control chip U1 is connected to the third pin of the connector JP1, the sixth pin of the control chip U1 is grounded, the third pin and the fourth pin of the control chip U1 are respectively connected to the first pin of the connector JP1, the second pin of the control chip U1 is connected to the second pin of the connector JP1, the first pin of the connector JP1 is respectively connected to the cathode of the diode D2 and the anode of the capacitor C1, the anode of the diode D2 and the cathode of the capacitor C1 are grounded, the anode of the diode D1 is connected to one end of the resistor R1, and the other end of the resistor R1 is connected to the input voltage, one end of the resistor R2 is grounded, and the other end of the resistor R2 is connected to the anode of the neon tube N-LD, the cathode of the neon tube N-LD is connected to the input voltage.

A time adjusting circuit is arranged on the first circuit board, the time adjusting circuit comprises a control chip U2, a capacitor C5, a diode D3, a rotary switch SW1 and a connector JP2, the first pin of the control chip U2 is connected to the third pin of the connector JP2, the second pin of the control chip U2 is grounded, the third pin of the control chip U2 is connected to the third pin of the rotary switch SW1, the fourth pin of the control chip U2 is connected to the first pin of the rotary switch SW1, the fifth pin of the control chip U2 is connected to the input voltage, the sixth pin of the control chip U2 is connected to the sixth pin of the rotary switch SW1, the seventh pin of the control chip U2 is connected to the fourth pin of the rotary switch SW1, the eighth pin of the control chip U2 is unconnected, the ninth pin of the control chip U2 is connected to the first pin of the connector JP2, the tenth pin of the control chip U2 is connected to the second pin of the connector JP2, one end of the diode D3 is connected to the first pin of the connector JP2, and the other end of the diode D3 is connected to the anode and input voltage of the capacitor C5, the cathode of the capacitor C5 is grounded, the second pin and the fifth pin of the rotary switch SW1 are grounded.

Above disclosure are merely some preferred embodiments of the present invention, and the present invention is not limited thereto. Any variations, equivalent replacement and modifications under the spirit and principle of the present invention shall be covered within the scope of the present invention,

I claim:

1. A time switch of controllable time adjustment, wherein the time switch comprises a switch housing, a control circuit board arranged inside the switch housing; an input terminal and an output terminal arranged on the bottom surface of the switch housing, a connecting piece for connecting the input terminal and the output terminal, a warped plate connecting to the switch housing by means of a rotating shaft; a first spring is provided between the warped plate and the connecting piece to enable the warped plate to sway around the rotating shaft and drive the connecting piece to sway; the swaying of the connecting piece causes the input terminal and the output terminal to complete closing and opening; and the control circuit board is electrically connected with the output terminal;

the time switch also comprises a waterproof rubber ring, the waterproof rubber ring is arranged inside the switch housing; and the waterproof rubber ring is provided between the warped plate, the connecting piece and the control circuit board.

2. The time switch of claim 1, wherein the time switch also comprises a bottom cover, the bottom cover is connected to the body of the time switch via a first buckle.

3. The time switch of claim 2, wherein an opening is provided on the top surface of the warped plate; a lamp cover is connected with the inner of the opening via a second buckle.

4. The time switch of claim 1, wherein the electromagnet comprises a copper coil, a coil framework, a second spring and an iron core; the second spring is sleeved on the iron core, the iron core is arranged inside the coil framework, the copper coil is wound and sleeved on the coil framework; the terminal is provided on the coil framework; and the copper coil is electrically connected to the terminal.

5. The time switch of claim 4, wherein the control circuit comprises a coil J1, a resistor R4, a resistor R3, a resistor R2, a resistor R1, a capacitor C1, a capacitor C4, a diode D1, a diode D2, a neon tube N-LD, a silicon controlled rectifier Q1, a control chip U1 and a connector JP1, an input voltage is connected to the input terminal of the coil, the output terminal of the coil is respectively connected to one end of the resistor R4 and the second pin of the silicon controlled rectifier Q1, the other end of the resistor R4 is grounded, the first pin of the silicon controlled rectifier Q1 is grounded, the third pin of the silicon controlled rectifier Q1 is connected to one end of the resistor R3, the other end of the resistor R3 is connected to the fifth pin of the control chip U1, one end of the capacitor C4 is grounded, and the other end is respectively connected to the third pin of a triode Q5 and the third pin of a triode Q1, the eighth pin of the control chip U1 is respectively connected to the third pin and the sixth pin of the connector JP1, the seventh pin of the control chip U1 is connected to the third pin of the connector JP1, the sixth pin of the control chip U1 is grounded, the third pin and the fourth pin of the control chip U1 are respectively connected to the first pin of the connector JP1, the second pin of the control chip U1 is connected to the second pin of the connector JP1, the first pin of the connector JP1 is respectively connected to the cathode of the diode D2 and the anode of the capacitor C1, the anode of the diode D2 and the cathode of the capacitor C1 are grounded, the anode of the diode D1 is connected to one end of the resistor R1, and the other end of the resistor R1 is connected to the input voltage, one end of the resistor R2 is grounded, and the other end of the resistor R2 is connected to the anode of the neon tube N-LD, the cathode of the neon tube N-LD is connected to the input voltage.

6. The time switch of claim 5, wherein a time adjusting circuit is arranged on the first circuit board, the time adjusting circuit comprises a control chip U2, a capacitor C5, a diode D3, a rotary switch SW1 and a connector JP2, the first pin of the control chip U2 is connected to the third pin of the connector JP2, the second pin of the control chip U2 is grounded, the third pin of the control chip U2 is connected to the third pin of the rotary switch SW1, the fourth pin of the control chip U2 is connected to the first pin of the rotary switch SW1, the fifth pin of the control chip U2 is connected to the input voltage, the sixth pin of the control chip U2 is connected to the sixth pin of the rotary switch SW1, the seventh pin of the control chip U2 is connected to the fourth pin of the rotary switch SW1, the eighth pin of the control chip U2 is unconnected, the ninth pin of the control chip U2 is connected to the first pin of the connector JP2, the tenth pin of the control chip U2 is connected to the second pin of the connector JP2, one end of the diode D3 is connected to the first pin of the connector JP2, and the other end of the diode D3 is connected to the anode and input voltage of the capacitor C5, the cathode of the capacitor C5 is grounded, the second pin and the fifth pin of the rotary switch SW1 are grounded.

* * * * *